US008635714B2

(12) United States Patent
Hazlett

(10) Patent No.: US 8,635,714 B2
(45) Date of Patent: Jan. 28, 2014

(54) SUPPORT BELT FOR USE WITH BODY ARMOR

(76) Inventor: Jason Hazlett, Mt. Dora, FL (US)

( * ) Notice: Subject to any disclaimer, the term of this patent is extended or adjusted under 35 U.S.C. 154(b) by 421 days.

(21) Appl. No.: 12/693,805

(22) Filed: Jan. 26, 2010

(65) Prior Publication Data

US 2011/0179553 A1 Jul. 28, 2011

(51) Int. Cl.
*A41F 9/00* (2006.01)

(52) U.S. Cl.
USPC ..... 2/311; 2/2.5

(58) Field of Classification Search
USPC ..... 2/311, 312, 300, 314, 315, 319, 919, 2/920, 102, 461, 462, 2.5, 455, 69, 463, 2/464, 465, 467, 456, 338; 224/675, 674, 224/684, 580, 583, 240, 250, 269; 24/3.7
See application file for complete search history.

(56) References Cited

U.S. PATENT DOCUMENTS

| | | | | | |
|---|---|---|---|---|---|
| D134,542 | S | * | 12/1942 | Wax | D3/230 |
| 3,817,245 | A | * | 6/1974 | Kroeger | 128/876 |
| 4,013,201 | A | | 3/1977 | Potter | |
| 4,318,502 | A | * | 3/1982 | Lowe et al. | 224/153 |
| 4,467,476 | A | | 8/1984 | Herbert | |
| 4,497,069 | A | * | 2/1985 | Braunhut | 2/2.5 |
| 4,602,386 | A | | 7/1986 | Hoffman et al. | |
| 5,259,093 | A | * | 11/1993 | D'Annunzio | 24/3.9 |
| 5,445,601 | A | * | 8/1995 | Harlow | 602/19 |
| 5,460,308 | A | * | 10/1995 | Hahn | 224/257 |
| 5,465,886 | A | * | 11/1995 | Scherer | 224/644 |
| 5,535,928 | A | * | 7/1996 | Herring | 224/250 |
| 5,586,969 | A | * | 12/1996 | Yewer, Jr. | 602/19 |
| 5,622,346 | A | * | 4/1997 | Story, Jr. | 248/311.2 |
| 5,724,707 | A | * | 3/1998 | Kirk et al. | 24/3.7 |
| 5,727,720 | A | * | 3/1998 | Thatcher | 224/664 |
| 5,745,925 | A | | 5/1998 | Ghilardi et al. | |
| 5,806,087 | A | * | 9/1998 | Grotefend | 2/1 |
| 5,834,789 | A | | 11/1998 | Marchione | |
| 6,015,073 | A | * | 1/2000 | Wojciak et al. | 224/251 |
| 6,088,831 | A | * | 7/2000 | Jensen et al. | 2/2.5 |
| 6,279,804 | B1 | * | 8/2001 | Gregg | 224/675 |
| 6,375,052 | B2 | * | 4/2002 | Keton | 224/222 |
| 6,634,533 | B2 | | 10/2003 | Thompson et al. | |
| 6,681,973 | B2 | * | 1/2004 | Crumrine | 224/637 |
| 6,691,906 | B2 | * | 2/2004 | Cragg | 224/238 |

(Continued)

OTHER PUBLICATIONS

Website showing the FLYYE BLS Belt Multicam CODRURA MOLLE BDU CRYE MARPAT sold on Nov. 20, 2008 http://www.worthpoint.com/worthopedia/flyye-bls-belt-multicam-codrura-molle-bdu-crye.*

(Continued)

*Primary Examiner* — Khoa Huynh
*Assistant Examiner* — Andrew W Collins
(74) *Attorney, Agent, or Firm* — Cohena Grigsby, P.C.

(57) ABSTRACT

A support belt for use with body armor is disclosed. The support belt has a central member that includes two oppositely disposed side members and at least one horizontal strap that has a vertical receiving channel. There are at least two support straps configured to releasably interlock with the vertical receiving channel and a plurality of straps secured to an outer surface of the body armor to form a support trough that transfers at least a portion of the weight of the body armor to the waist of the wearer. There is a closure device to secure the side members to each other to secure the belt substantially around the wearer's waist.

19 Claims, 9 Drawing Sheets

(56) References Cited

U.S. PATENT DOCUMENTS

| | | | | |
|---|---|---|---|---|
| 6,925,652 | B2 * | 8/2005 | Feng | 2/2.15 |
| 7,047,570 | B2 * | 5/2006 | Johnson | 2/102 |
| 7,240,404 | B2 * | 7/2007 | Flossner | 24/3.7 |
| 7,243,376 | B2 * | 7/2007 | Johnson | 2/102 |
| 7,386,894 | B2 * | 6/2008 | Straiton | 2/228 |
| 7,845,024 | B2 * | 12/2010 | Hill | 2/310 |
| 2002/0120973 | A1 * | 9/2002 | D'Annunzio | 2/92 |
| 2004/0221361 | A1 * | 11/2004 | D'Annunzio | 2/69 |
| 2005/0005343 | A1 * | 1/2005 | Johnson | 2/102 |
| 2006/0143771 | A1 * | 7/2006 | Winkle et al. | 2/69 |
| 2007/0074327 | A1 | 4/2007 | Davies et al. | |
| 2007/0079415 | A1 | 4/2007 | Carlson | |
| 2007/0107109 | A1 * | 5/2007 | Johnson | 2/102 |
| 2008/0010730 | A1 | 1/2008 | Twito et al. | |
| 2008/0120768 | A1 * | 5/2008 | Tsujimoto | 2/463 |
| 2008/0257922 | A1 * | 10/2008 | Cragg | 224/269 |
| 2009/0044310 | A1 | 2/2009 | Baacke | |

OTHER PUBLICATIONS

Website showing the FLYYE BLS Belt Multicam CODRURA MOLLE BDU CRYE MARPAT sold on Aug. 27, 2008 http://www.worthpoint.com/worthopedia/flyye-bls-belt-multicam-codrura-molle-bdu-crye-1.*

Definition for Lorica Mamata, Jul. 2009, http://www.redrampant.com/2009/07/ancient-roman-armor.html.

Omni Belt, Feb. 4, 2010, http://www.kifaru.net/G2_omnibelts.html.

Bulletproof Vest with Module Design for Police, Aug. 28, 2009, http://www.ujic.com.tw/en/products.htm#Bulletproof.

* cited by examiner

SUPPORT BELT FOR USE WITH BODY ARMOR

BACKGROUND

Soldiers and law enforcement officers who wear body armor often have to wear the armor for lengthy time periods and carry the armor for long distances. The heavy weight of the body armor and the weight of the equipment attached to the body armor place substantial weight and strain on the user's shoulders. All of these factors are of concern because of the fatigue and strain on the back and shoulders that carrying such heavy loads induces.

SUMMARY

A support belt for use with body armor is disclosed. In an embodiment, the support belt has a central member that includes two oppositely disposed side members and an upper portion configured to interface with an inner surface of the body armor and at least one horizontal strap that has a vertical receiving channel. The support belt also has at least two support straps separated from each other by a distance. Each support strap has first and second ends and is substantially aligned with one of the vertical receiving channels. The second end of each support strap is configured for insertion into one of the vertical receiving channels in a first direction and for extension in a second direction to releasably interlock with a plurality of straps secured to an outer surface of the body armor to form a support trough that transfers at least a portion of the weight of the body armor to the waist of the wearer. There is a closure device to secure the side members to each other to secure the belt substantially around the wearer's waist.

In another embodiment, the support belt has a central member shaped to sit substantially on a wearer's waist. The central member has at least one horizontal strap that has a vertical receiving channel. There are two oppositely disposed side members that extend from the central member. Each side member has a closure device configured for attachment to a closure device on the other side member to secure the support belt around the wearer's waist. An upper portion is disposed substantially above the central member that is configured to interface with an upper surface of the body armor. There are at least two support straps configured at a second end to releasably interlock with a plurality of straps on an outer surface of the body armor to transfer at least a portion of the weight of the body armor to the waist of the wearer.

In another embodiment, a support belt in combination with a piece of body armor is disclosed. The body armor has a plurality of rows of straps attached to an outer surface. The support belt has a central member that includes two oppositely disposed side members and an upper portion configured to interface with an inner surface of the body armor. The central member also has at least one horizontal strap that has a vertical receiving channel. The support belt has at least two support straps separated from each other by a distance. Each support strap has first and second ends and is substantially aligned with one of the vertical receiving channels. The second end of each support strap is configured for insertion into one of the vertical receiving channels in a first direction and for extension in a second direction to releasably interlock with the plurality of rows of straps secured to the outer surface of the body armor to form a support trough. The support trough transfers at least a portion of the weight of the body armor to the waist of the wearer. There is a closure device to secure the side members to each other to secure the support belt substantially around the wearer's waist.

These and other details, objects, and advantages of the disclosed support belt will become better understood or apparent from the following descriptions, examples, and figures showing embodiments thereof.

BRIEF DESCRIPTION OF THE DRAWINGS

In the drawings which are attached hereto and made a part of this disclosure.

DETAILED DESCRIPTION

Figure 5:
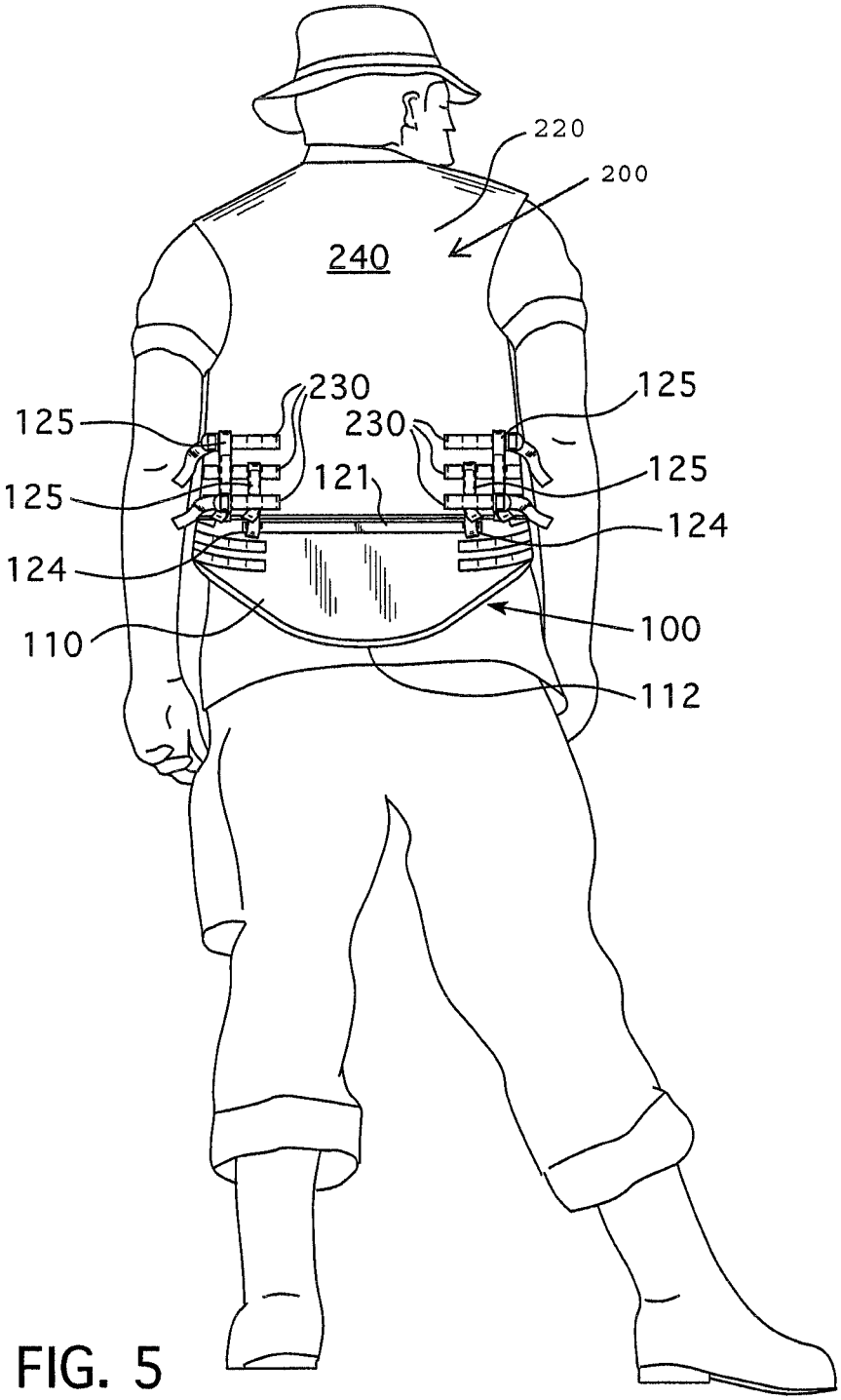
FIG. 5 is a back view of an embodiment of the support belt in use on a user wearing body armor.

As shown in FIG. 5, the support belt 100 is for use with body armor vests 200 such as those typically worn by soldiers and law enforcement officers. As is known in the art, the vest 200 is configured with a plurality of spaced-apart strips of webbing 230 attached at sequentially spaced-apart intervals to an outer surface 240 thereof to form receiving channels 250. The strips of webbing 230 are positioned on the outer surface 240 of the vest 200 in a generally horizontal direction. In an example, the vest 200 is configured with the Pouch Attachment Ladder System (PALS). As described in greater detail below, the support belt 100 has support straps 125 that are sized to fit within the receiving channels 250 of the vest 200. When the second end 127 of at least one support strap 125 is inserted into the receiving channel 250 of the vest 200 so as to be interlocked with the webbing 230, at least a portion of the weight of the body armor vest 200 is transferred from the wearer's shoulders to the wearer's waist and/or hips.

Figure 1:
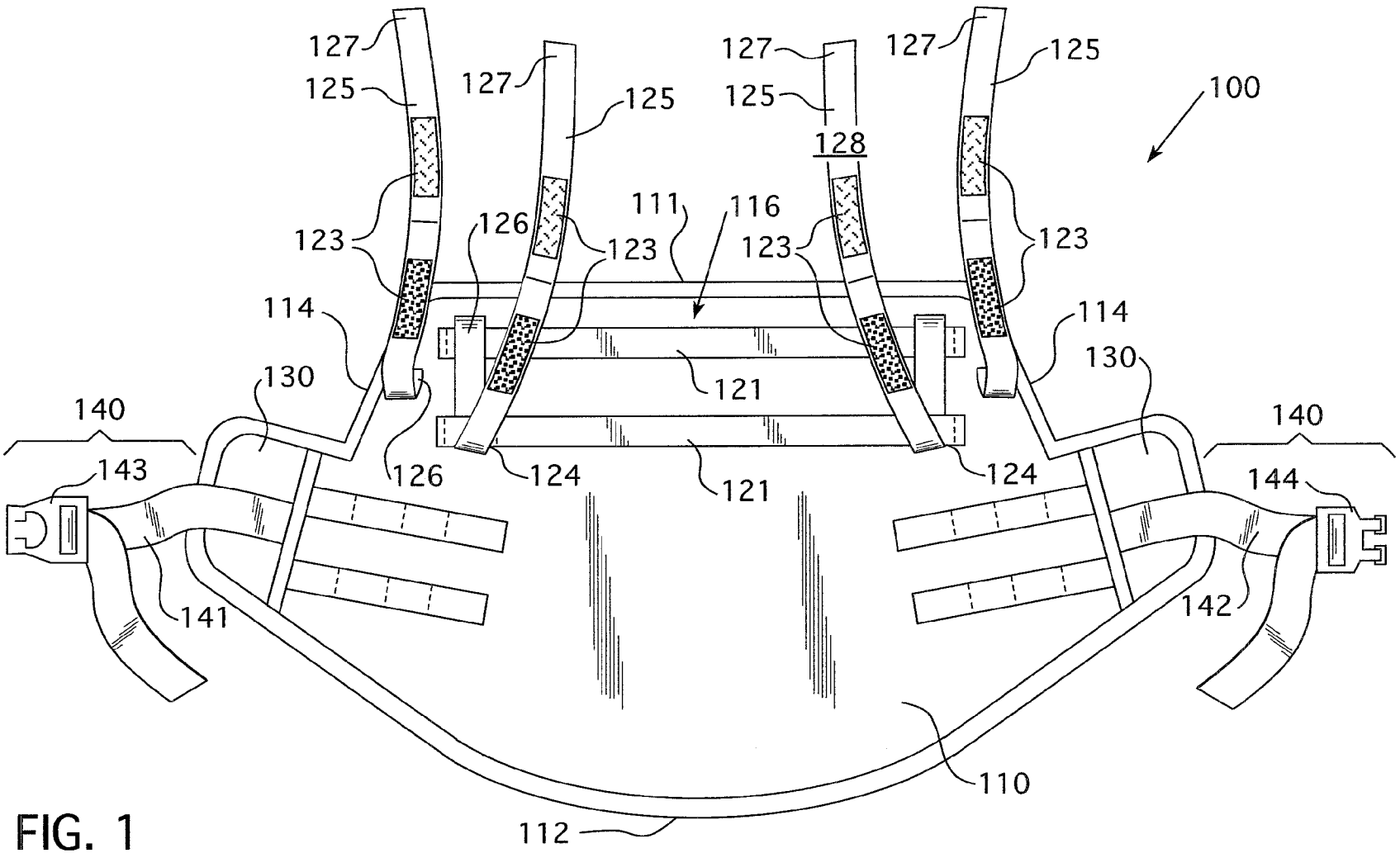
FIG. 1 is a back view of an embodiment of the support belt.

FIG. 1 shows a back view of an embodiment of the support belt 100 having a central member 110, four flexible support straps 125 separated from each other by a distance, and a closure device 140. The central member 110 is configured to sit substantially on the user's waist. The central member 110 has a top edge 111 and a bottom edge 112. In an embodiment, the bottom edge 112 is substantially straight (not shown). In another embodiment, the bottom edge 112 is arched as shown in FIGS. 1, 2, and 4-8. The central member 110 is made from any abrasion-resistant material. Examples of materials from which the central member 110 is made include nylon or closed cell foam, although any abrasion-resistant material may be used and is contemplated by the present disclosure. In an embodiment, the central member 110 includes padding 115. See FIG. 2.

Figure 7:
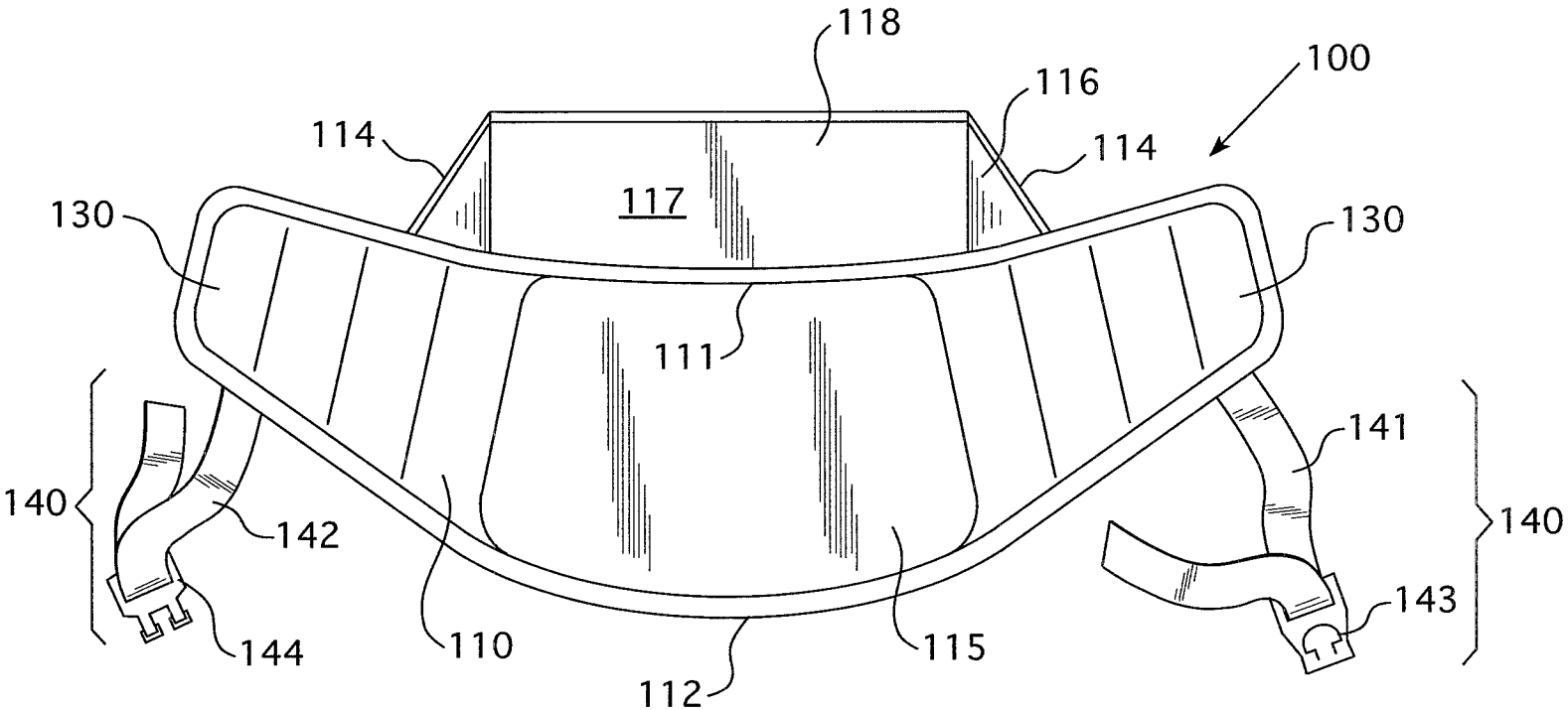
FIG. 7 is a front view of an embodiment of the support belt.
Figure 8:
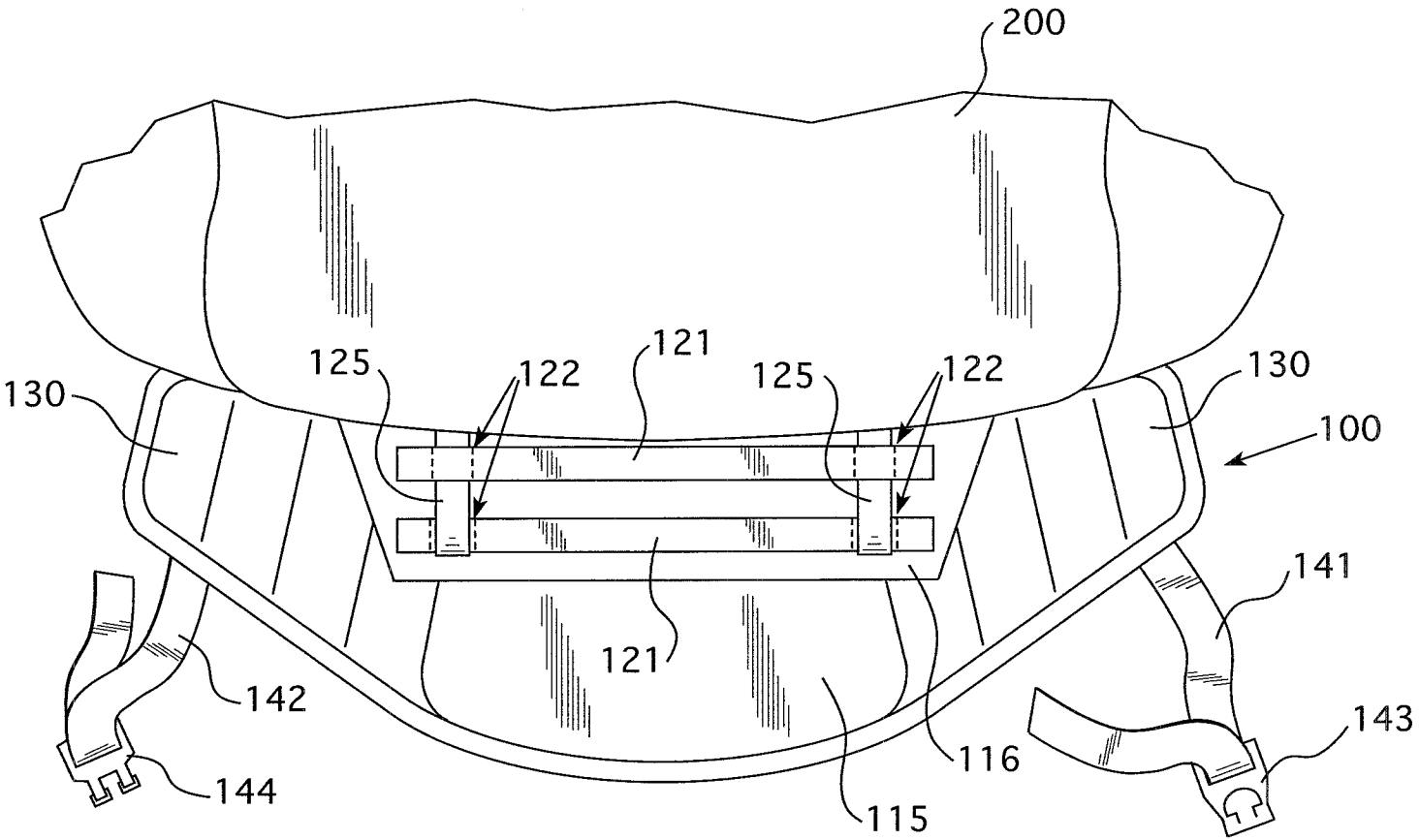
FIG. 8 is a front view of an embodiment of the support belt.

As shown in FIG. 7, the central member 110 includes an upper portion 116 that has a surface 117 configured to interface with an inner surface of the body armor vest. The upper portion 116 is sized to fit substantially across the wearer's lower back. As shown in FIG. 1, the sides 114 of the upper portion 116 are contoured to fit against the wearer's sides in use. In an example, and as shown in FIG. 7, the upper portion 116 includes a reinforcement 118 such as a piece of plastic to provide a semi-rigid support.

Figure 2:
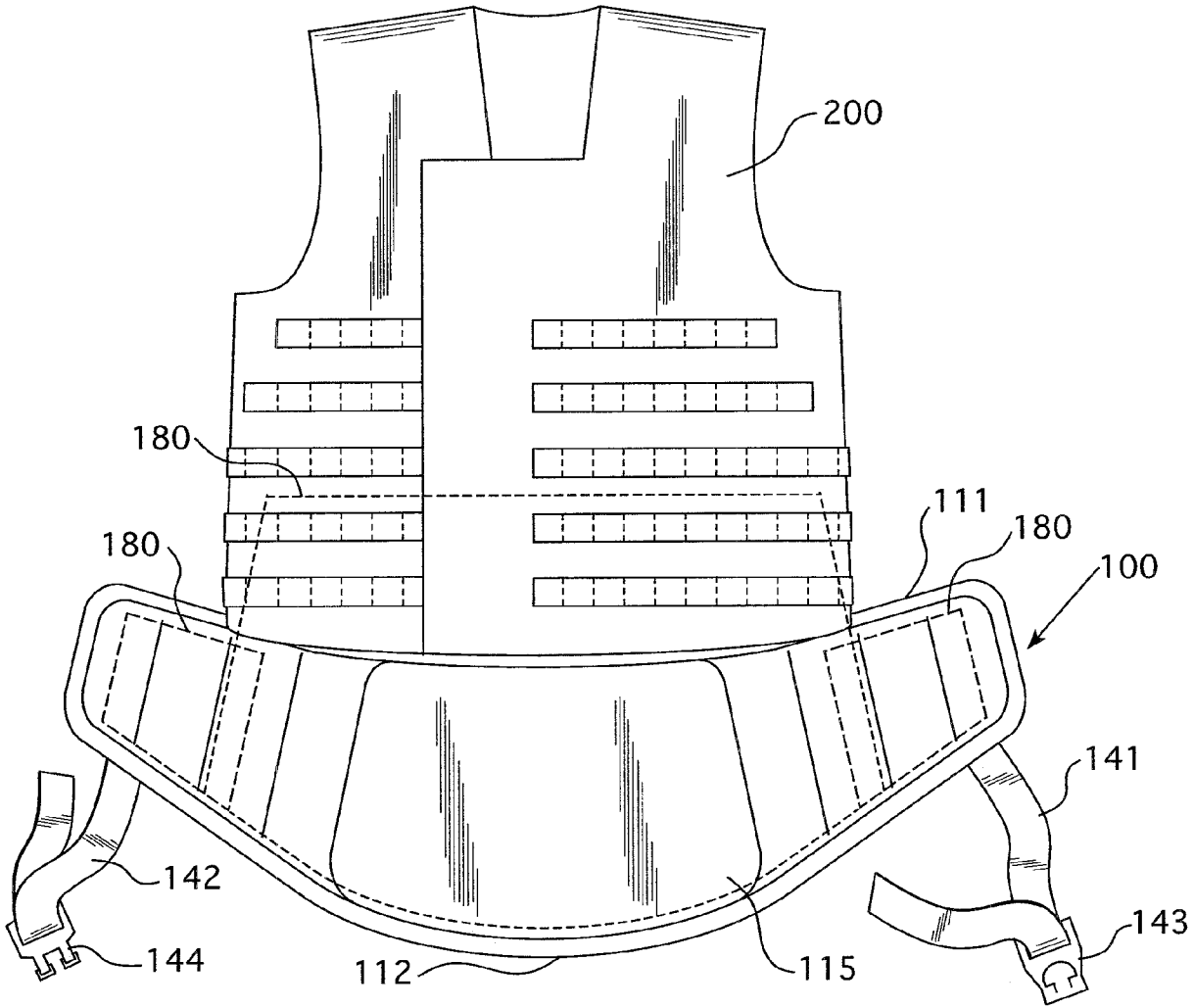
FIG. 2 is a front view of an embodiment of the support belt attached to body armor.
Figure 6:
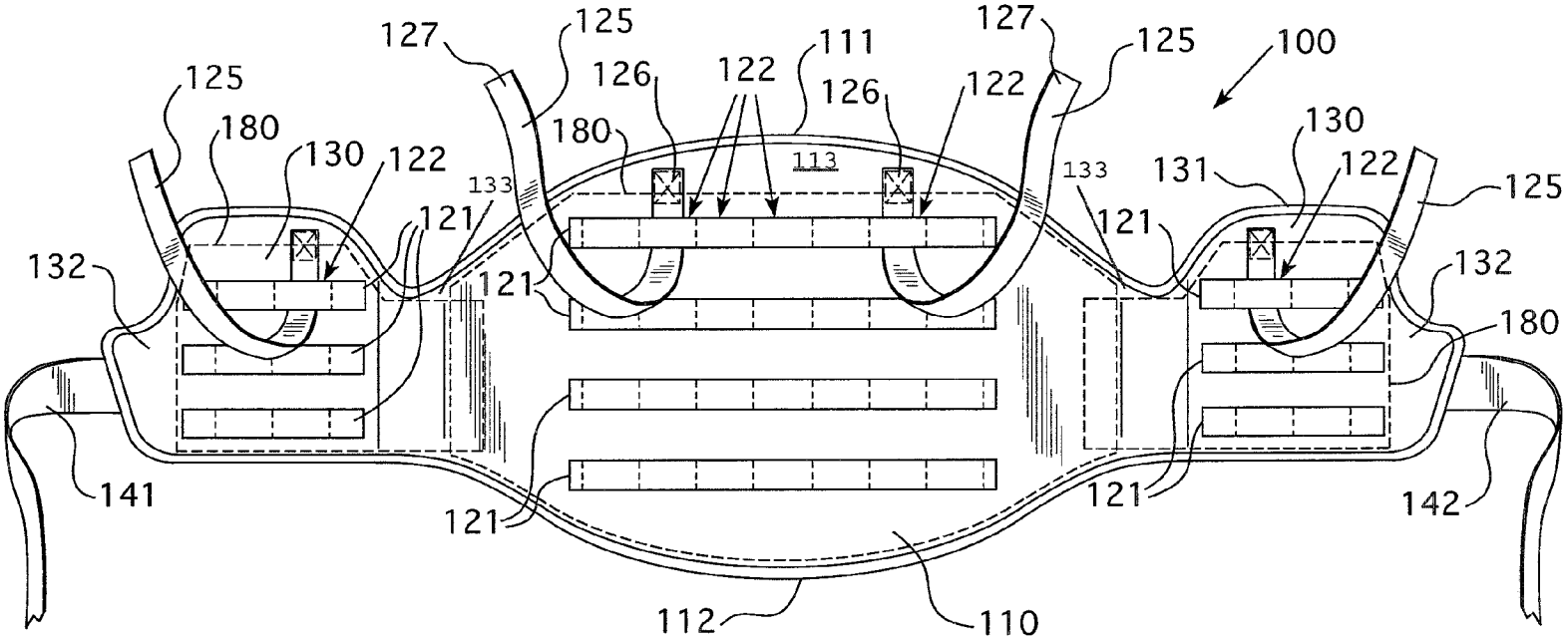
FIG. 6 is a back view of an embodiment of the support belt.

Optionally, the central member 110 is configured with at least one pocket 180 as shown in FIGS. 2 and 6. The pockets 180 are sandwiched between the front and rear panels of the central member 110. In an embodiment, each pocket is configured to receive a section of bullet-proofing material such as Kevlar®.

The support belt 100 has at least one substantially horizontal strap 121 and at least two support straps 125. The horizontal strap 121 extends substantially along the length of the upper portion 116 of the central member 110 and is attached to the upper portion 116 of the central member 110 at sequentially spaced-apart intervals to form a plurality of vertical receiving channels 122 each configured to receive one of the support straps 125. In an embodiment, there are at least two horizontal straps 121 positioned substantially parallel to each other in order to increase the weight that the support belt 100 is configured to transfer and to accommodate movability and adjustability of the support straps 125. The vertical receiving channels 122 of the at least two horizontal straps 121 are substantially aligned.

As shown generally in the figures, the support belt 100 has at least two support straps 125 having first 126 and second 127 ends. In an embodiment, the support straps 125 are removable and can be positioned anywhere along the length of the horizontal strap 121 to align with one of the vertical receiving channels 122. In an embodiment, the support straps 125 are attached at a first end 126 to one of the horizontal straps 121 as shown in FIG. 1. In another embodiment, the support straps 125 are secured at a first end 126 to the surface 113 of the central member 110, such as by stitching, a hook and latch system, a snap mechanism, adhesion means, or the like, as shown in FIG. 6. The support straps 125 are separated from each other by a distance. Each support strap 125 has a first 128 and second 129 surface. The width of each support strap 125 is sized to fit into the receiving channels 122 of the horizontal straps 121 and the vertical receiving channels 250 of the body armor vest 200. Each support strap 125 has a length sufficient to engage at least one of the receiving channels 250 on the vest 200 when the support belt 100 is in use. Optionally, the support straps 125 have an adjustable length. In use, the second end 127 of each support strap 125 is configured to be releasably inserted in a downward vertical direction through the vertically aligned receiving channels 122 of the horizontal straps 121 and then in an upward vertical direction through the receiving channels 250 on the vest 200 to form an interlocking grid. While any flexible, heavy-duty material may be used for the support straps 125 and is contemplated by the present disclosure, examples of materials from which the support straps 125 may be made include nylon and leather.

Figure 3A:
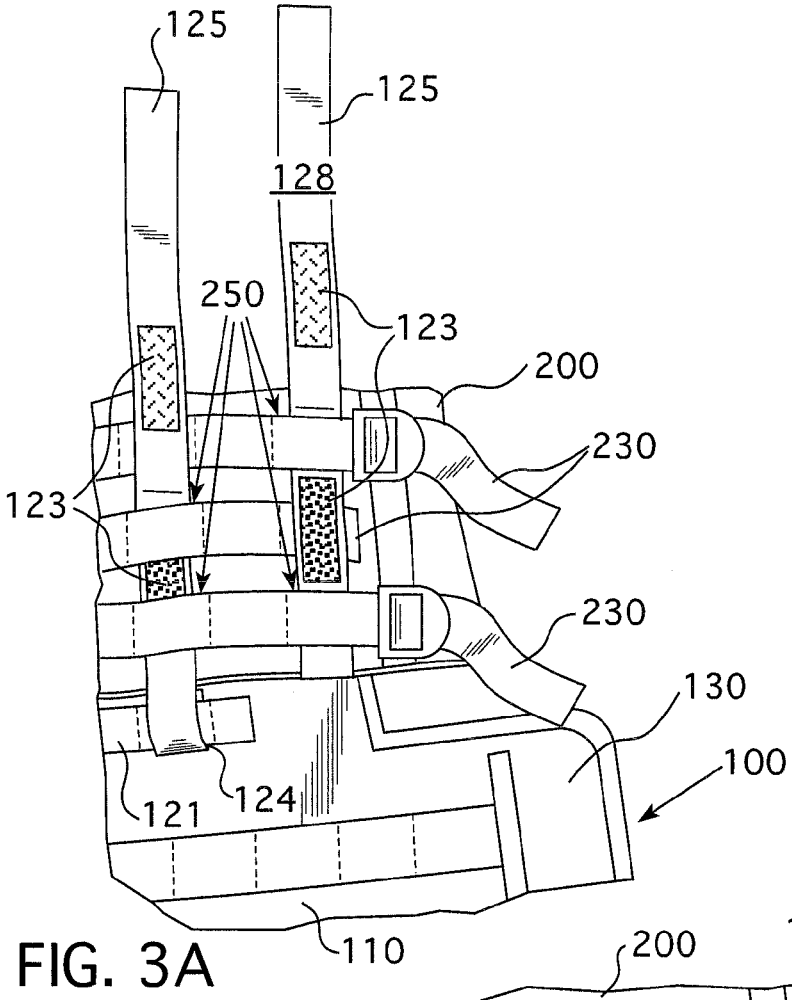
FIG. 3 is a back view of a segment of the support belt attached to body armor, showing the straps in the unsecured (panel A), partially secured (panel B), and completely secured (panel C) positions.
Figure 3B:
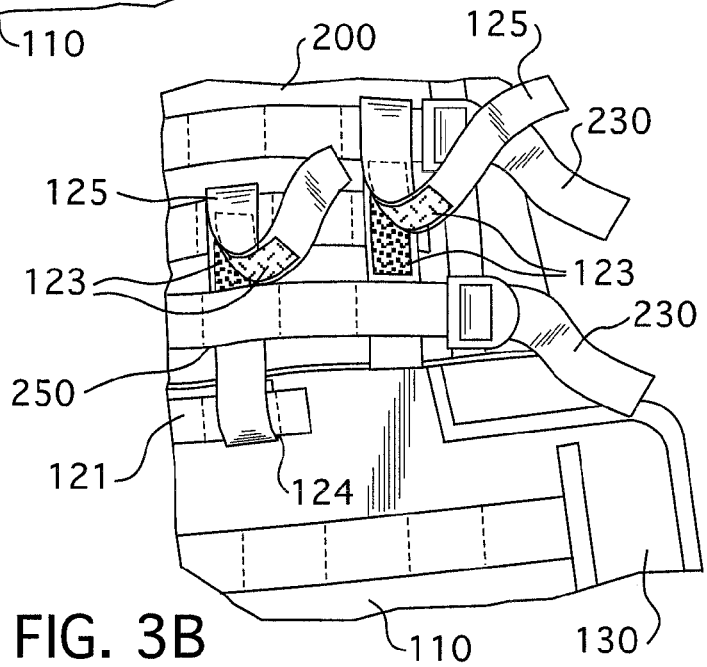
Figure 3C:
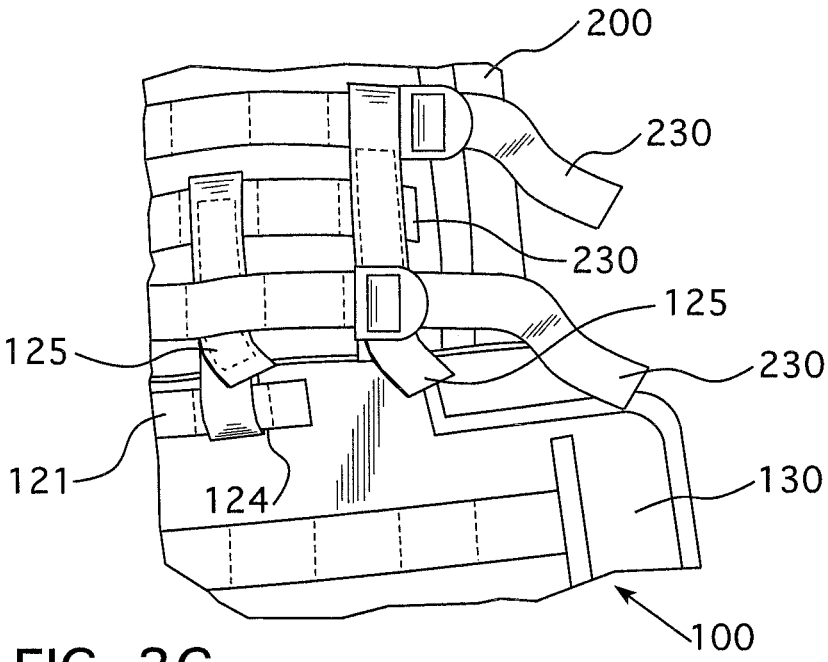
Figure 4:
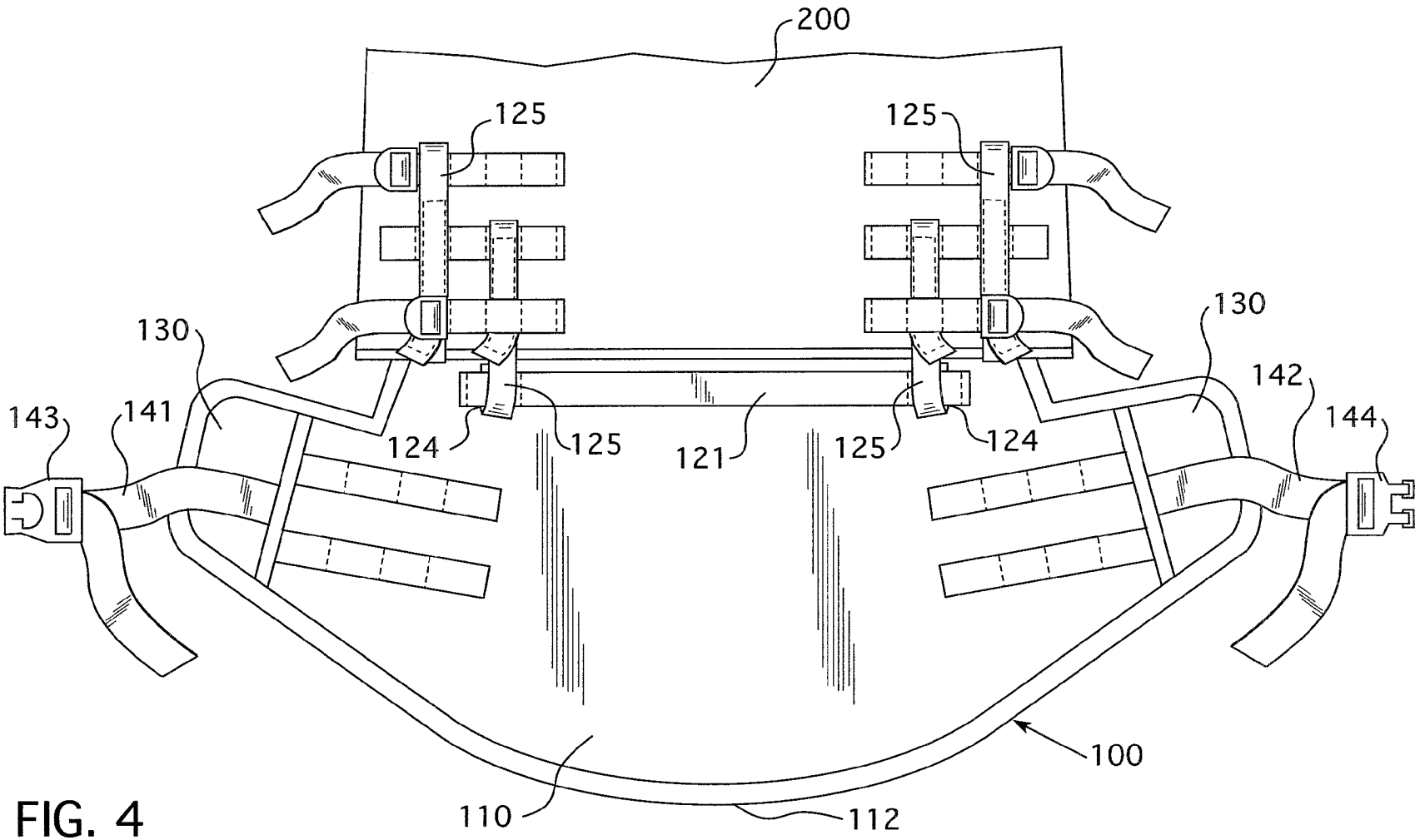
FIG. 4 is a back view of an embodiment of the support belt attached to body armor.

Each support strap 125 has a securing element. As shown in FIG. 3, the securing element 127 is a hook and latch system having spaced-apart pieces of hook and latch material affixed to the first surface 128 of each support strap 125. The pieces of hook and latch material are separated by a distance such that, in use, the support strap 125 is extended upwardly through the receiving channels 250 of the body armor vest 200 and is then looped over one of the pieces of webbing 230 on the body armor vest 200 so that the pieces of hook and latch material of the securing element 123 engage each other. FIG. 3A shows two support straps 125 extended upwardly through receiving channels 250 of the body armor vest 200. FIG. 3B shows the two support straps 125 each folded over with the hook and latch systems partially engaged. FIG. 3C shows the hook and latch system in the fully engaged position. When the hook and latch system of each support strap 125 is fully engaged as in FIG. 3C, the support straps 125 transfer a portion of the weight of the vest 200 downward from the user's shoulders to the wearer's waist, forming a support trough 124 at the base of each support strap 125 to support a portion of the weight of the vest 200.

In other embodiments, the securing element 123 is a snap, button and button hole, or any other securing element known to those skilled in the art that would not interfere with the intended purpose of the support straps 125.

As shown in the figures, two oppositely disposed side members 130 extend from the central member 110. The top edge 131 of each side member 130 is substantially aligned with the bottom edge 119 of the upper portion 116 of the central member 110. Each side member 130 has first 132 and second 133 ends. In an embodiment, the side members 130 are integral with the central member 110. In another embodiment, each side member 130 is attached at its second end 133 to the central member 110, such as by stitching. In an embodiment such as the one shown in FIG. 1, the side members 130 are configured to extend substantially around the user's waist. In use, first ends 132 of the two side members 130 are substantially adjacent to form a generally circular belt that is configured to sit substantially on the wearer's waist. Optionally, at least the front of each of the side members 130 includes padding 115. See FIG. 2. Optionally, and as shown in FIG. 6, at least one of the side members 130 includes a horizontal strap 121 and at least one support strap 125, each as described above.

As shown in FIG. 1, a closure device 140 secures the side members 130 to each other to secure the support belt 100 substantially around the wearer's waist. The closure device 140 has first 141 and second 142 closure straps and first 143 and second 144 members attached thereto, respectively. First 143 and second 144 members of closure device 140 are configured for releasable engagement in the closed position. Although the figures show the closure device 140 as a snap buckle that has male and female members, the present disclosure contemplates any closure device known to those skilled in the art that is suitable for releasably securing the support belt 100 around the wearer's waist. In another embodiment, first member 143 of the closure device 140 is attached directly to one side member 130 of the support belt 100 and second member 144 of the closure device 140 is attached directly to the other side member 130 of the support belt 100, as shown in FIG. 1.

In use and as shown in FIG. 5, the support belt 100 is attached to the vest 200 by positioning the front of the vest 200 on a surface so that the back 220 of the vest is facing up. The support belt 100 is positioned on the surface such that the upper portion 116 of the central member 110 engages the inner surface of the back of the vest 200 and the upper top edge 111 of the central member 110 is substantially aligned with the lower edge of the back of the vest 220. Each support strap 125 is extended in the vertical direction and is woven through the receiving channels 250 formed by the webbing 230 on the vest 200. The support strap 125 is looped over one of the pieces of webbing 230 on the vest and folded over so that the pieces of hook and latch material 123 engage each other. The vest 200 is placed on the wearer and the side members 130 are wrapped around the wearer's waist such that first ends 132 are substantially aligned. Closure device 140 is secured to releasably secure the support belt 100 substantially around the user's waist.

While the foregoing has been set forth in considerable detail, it is to be understood that the drawings, detailed embodiments, and examples are presented for elucidation and not limitation. Design variations, especially in matters of shape, size, and arrangements of parts, may be made but are within the principles of the invention. Those skilled in the art will realize that such changes or modifications of the invention or combinations of elements, variations, equivalents, or improvements therein are still within the scope of the invention as defined in the appended claims.

I claim:

1. A support belt for use with body armor that has vertical receiving channels on the outer surface thereof, said support belt comprising:

a central member having an outer surface that is defined between a top edge and a bottom edge, said central member including two oppositely disposed side members and an upper portion, said upper portion being bounded by the top edge of said central member and configured to interface with an inner surface of the body armor;

at least one horizontal strap that is connected to the outer surface of said central member, said horizontal strap extending substantially along a length of said upper portion of said central member that interfaces with the inner surface of the body armor, said horizontal strap being attached to said central member at sequentially spaced-apart intervals to form a plurality of vertical receiving channels;

at least two flexible vertical support straps, each of said support straps having first and second ends with each of said first ends being connected to said outer surface of said central member at a location between said horizontal strap and the top edge of said central member, said support straps being separated from each other by a distance and configured to form a releasably interlocking grid by insertion of the second end of each of said vertical support straps into one of said vertical receiving channels of a horizontal strap that is located on the outer surface of said central member between the first end of said receiving strap and the bottom edge of said central member, the second end of each of said vertical support straps also being inserted through a vertical receiving channel on the outer surface of said body armor, wherein in use a support trough is formed by said vertical support straps along an edge of said body armor that supports at least a portion of the weight of the body armor; and a closure device to secure the side members to each other to secure the belt substantially around a wearer's waist.

2. The support belt as in claim 1 wherein an end of each of the at least two support straps is attached to the horizontal strap.

3. The support belt as in claim 1 wherein an end of each of the at least two support straps is secured to the central member.

4. The support belt as in claim 1 wherein the support straps are removable.

5. The support belt as in claim 1 wherein each support strap has a securing element.

6. The support belt as in claim 1 wherein the side members are integral with the central member.

7. The support belt as in claim 1 further comprising at least one pocket positioned within the central member.

8. The support belt as in claim 1 further comprising at least one pocket positioned within at least one of the side members.

9. A support belt for use with body armor that has an inner surface and an outer surface with vertical receiving channels on the outer surface thereof, said support belt comprising:

a central member having an outer surface that is defined between a top edge and a bottom edge, said central member shaped to sit substantially on a wearer's waist and having an upper portion that interfaces with the inner surface of the body armor;

two oppositely disposed side members extending from the central member, each side member having a closure device configured for attachment to a closure device on the other side member to secure the belt around the wearer's waist;

at least one horizontal strap that is connected to the outer surface of said central member, said horizontal strap extending substantially along a length of said upper portion that interfaces with the inner surface of the body armor, said horizontal strap being attached to said central member at sequentially spaced-apart intervals to form a plurality of vertical receiving channels; and at least two flexible vertical support straps, each of said vertical support straps having first and second ends with each of said first ends being connected to said outer surface of said central member at a location on said outer surface of said central member between said horizontal strap and the top edge of said central member, said support straps being configured to form a releasably interlocking grid by insertion of the second end of each of said vertical support straps into one of said vertical receiving channels of a horizontal strap that is located on the surface of said central member between the first end of said receiving strap and the bottom edge of said central member, the second end of each of said vertical support straps also being inserted through a vertical receiving channel on the outer surface of the body armor to form a support trough along an edge of said body armor that supports at least a portion of the weight of the body armor.

10. The support belt as in claim 9 wherein a first end of each of the at least two support straps is attached to the horizontal strap.

11. The support belt as in claim 9 wherein a first end of each of the at least two support straps is secured to the central member.

12. The support belt as in claim 9 wherein the support straps are removable.

13. The support belt as in claim 9 wherein each support strap has a securing element.

14. The support belt as in claim 9 further comprising at least one pocket positioned within the central member.

15. The support belt as in claim 9 further comprising at least one pocket positioned within at least one of the side members.

16. A support belt in combination with a piece of body armor having a plurality of rows of straps attached to an outer surface thereof, each row of said straps having a first plurality of vertical receiving channels, the support belt comprising:

a central member having an outer surface that is defined between a top edge and a bottom edge, said central member including two oppositely disposed side members and an upper portion, said upper portion being bounded by the top edge of said central member and configured to interface with an inner surface of the body armor;

at least one horizontal strap that is connected to the outer surface of said central member, said horizontal strap extending substantially along a length of said upper portion of said central member that interfaces with the inner surface of the body armor, said horizontal strap being attached to said central member at sequentially spaced-apart intervals to form a second plurality of vertical receiving channels;

at least two flexible vertical support straps, each of said support straps having first and second ends with each of said first ends being connected to said outer surface of said central member at a location on said outer surface of said central member between said horizontal strap and the top edge of said central member, said support straps being separated from each other by a distance and configured to form a releasably interlocking grid by insertion of the second end of each of said vertical support straps into one of said first plurality of vertical receiving channels, the second end of each of said vertical support straps also being inserted through one of said second plurality of vertical receiving channels of a horizontal strap that is located on the outer surface of the central member between the first end of said receiving strap and the bottom edge of said central member, wherein in use the vertical support straps form a support trough that supports at least a portion of the weight of the body armor; and a closure device to secure the side members to each other to secure the belt substantially around a wearer's waist.

17. The support belt as in claim 16 wherein each support strap has a securing element.

18. The support belt as in claim 16 further comprising at least one pocket positioned within the central member.

19. The support belt as in claim 16 further comprising at least one pocket positioned within at least one of the side members.

* * * * *